US005442987A

United States Patent [19]

Davis

[11] Patent Number: 5,442,987

[45] Date of Patent: Aug. 22, 1995

[54] APPARATUS TO VARY THE PITCH OF A DESIGNATED STRING OF A MUSICAL INSTRUMENT

[76] Inventor: Bradford F. Davis, 715 Skyview Dr., Nashville, Tenn. 37206

[21] Appl. No.: 165,319

[22] Filed: Dec. 13, 1993

[51] Int. Cl.[6] ..... G10D 3/14; G10G 7/02

[52] U.S. Cl. ..... 84/312 R; 84/312 P; 84/313; 84/455

[58] Field of Search ..... 84/312 R, 312 P, 313, 84/454, 455

[56] References Cited

U.S. PATENT DOCUMENTS

| | | | |
|---|---|---|---|
| 2,136,627 | 11/1938 | Lohman | 84/313 |
| 2,889,732 | 6/1959 | Juricek | 84/312 R |
| 2,893,282 | 7/1959 | Searles | 84/313 |
| 2,949,806 | 8/1960 | Turman | 84/297 |
| 3,686,993 | 8/1972 | Fender | 84/312 R |
| 3,721,150 | 3/1973 | Hoffman et al. | 84/313 |
| 4,354,417 | 10/1982 | Glaser, II | 84/312 R |
| 5,140,884 | 8/1992 | Bowden | 84/312 R |

*Primary Examiner*—Michael L. Gellner
*Assistant Examiner*—Eddie C. Lee
*Attorney, Agent, or Firm*—Robert B. Crouch

[57] ABSTRACT

Apparatus for selectively increasing the pitch of a string of a string instrument at any time while the instrument is being played in a normal manner. The apparatus includes a string guide which is adapted to bear against a tuned string of the instrument, reciprocating means adapted to be mounted on the peghead of the instrument and secured to the string guide, and an actuator operatively connected to the reciprocating means for selectively moving the string guide to "bend" the associated string and increase the tension thereon a predetermined amount.

1 Claim, 1 Drawing Sheet

APPARATUS TO VARY THE PITCH OF A DESIGNATED STRING OF A MUSICAL INSTRUMENT

The present invention relates to apparatus for selectively varying the pitch of a tuned string of a string musical instrument.

BACKGROUND OF THE INVENTION

In tuning a string instrument, such as a guitar, mandolin, etc., the tension on each string is individually adjusted to bring the tone emitted into harmony with that of each of the others. This typically involves manually turning a peg attached to the string so as to put more, or less, tension on the string and thereby increase or decrease the frequency of vibration. This is a painstaking process, so that once an instrument is tuned, the tone emitted by a particular string is varied only by the musician pressing the string against the frets spaced along the finger board. When playing such an instrument, the musician sometimes desires to create a distinctive sound. Heretofore, such sounds have been limited to the final note of a musical composition or, in the case of an electric guitar, a note which is held for several beats. With an acoustic instrument a single peg can be adjusted by the musician with one hand to vary the pitch of a string while it is strummed with the other hand. This technique is occasionally employed, but it is limited to situations where the instrument can be retuned immediately thereafter. In the case of an electric guitar, this effect can be achieved by manipulation of a handle on the body of the instrument with the hand that strikes the note or chord. In either case, the normal playing action of the musician is interrupted, since one hand or the other is required to produce the distinctive sound instead of continuing to play the instrument in the usual manner.

SUMMARY OF THE INVENTION

The present invention avoids the limitations of the prior art by provision of apparatus which allows a musician to create a distinctive sound from a string instrument at any time while the instrument is being played in a normal manner. The apparatus can be attached to an existing acoustic or electric guitar, banjo, mandolin, dobro, etc. and activated by the musician whenever it is desired. The apparatus can be set to increase the pitch of a string by a half or a full note on the musical scale, thereby allowing the musician to create distinctive chords or sounds intermittently at will.

The apparatus of the present invention includes a device adapted to be mounted on the instrument, preferably on the peghead, immediately adjacent the adjustable anchor of a desired string. The device includes a reciprocating element for "bending" the string with which it is associated and an actuator which is controlled by movement of the musician.

DRAWING

The best mode presently contemplated of carrying out the invention will be understood from the detailed description of the preferred embodiment illustrated in the accompanying drawing in which.

DETAILED DESCRIPTION

Figure 2:
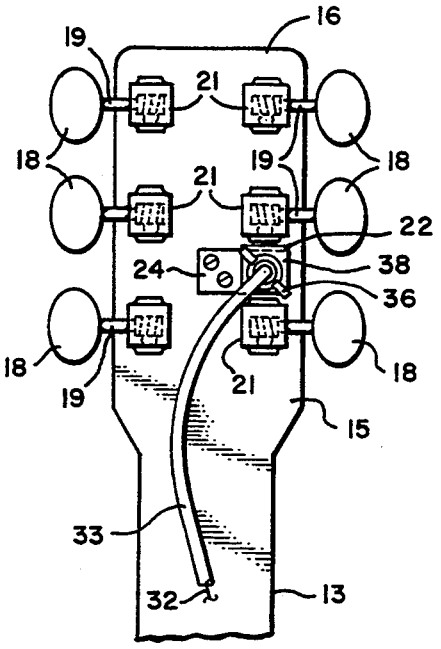
FIG. 2 is a plan view taken along lines 2—2 of FIG. 1 showing the rear surface of the peghead with the present invention installed.
Figure 5:
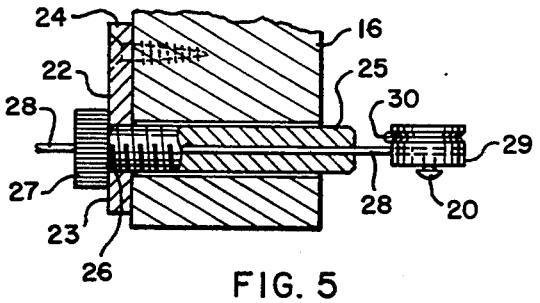
FIG. 5 is a plan view partly in section and at an enlarged scale taken along lines 5—5 of FIG. 1.
Figure 1:
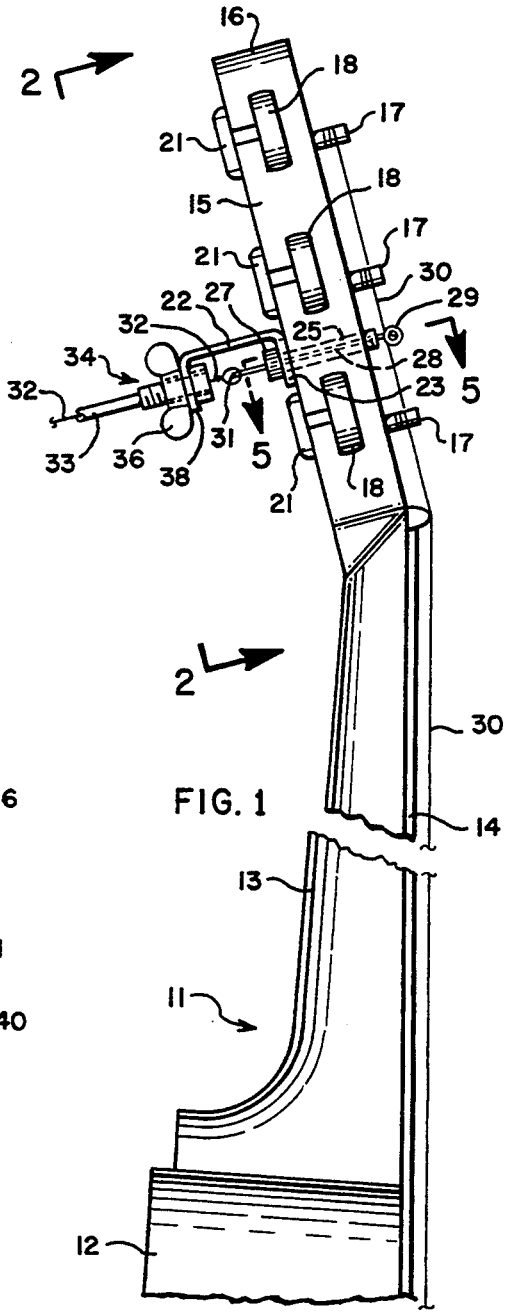
FIG. 1 is an elevation view of the apparatus of the present invention installed on an acoustic guitar.
Figure 3:
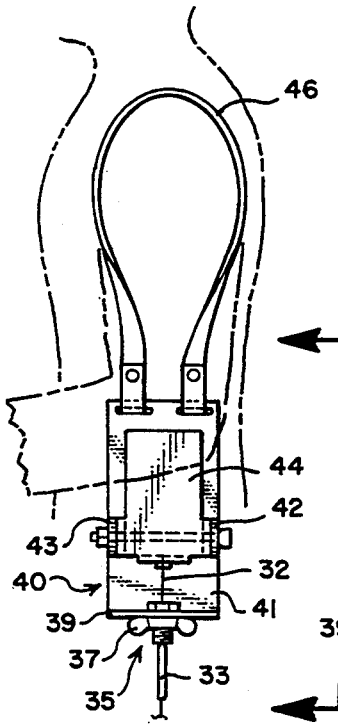
FIG. 3 is an elevation view of an actuator for use with the present invention.
Figure 4:
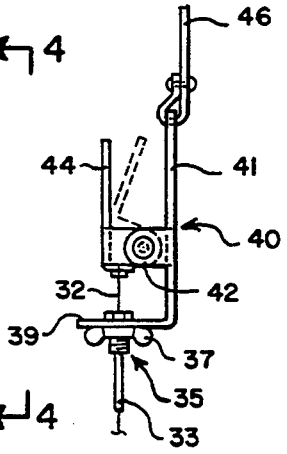
FIG. 4 is an elevation view of the actuator taken along lines 4—4 of FIG. 3.

Referring more particularly to FIGS. 1 and 2 of the drawing, an acoustic guitar is illustrated at 11 as including a body 12, an elongated neck 13 extending from the body 12, a finger board 14 extending along a surface of the neck, and a peghead 15 mounted on the extremity of the neck removed from the body. The peghead 15 includes a generally-rectangular section 16 extending at an acute angle to the longitudinal axis of the neck 13 with a plurality of string-anchoring pegs 17 and the associated actuating mechanisms mounted thereon. As illustrated, each such mechanism includes a knob 18 mounted on a laterally-extending shaft 19 which is connected through a spur and worm gear assembly, shown diagramatically at 21, to a peg 17 which protrudes from the upper surface of the section 16. The apparatus of the present invention includes a generally rectangular housing 22 having an end member 23 which includes a laterally-extending flange 24, shown in FIG. 2, for attachment to the rear surface of section 16. An externally-threaded bolt 25 is received within an internally-threaded opening 26 in the end member 23 and extends through a hole (not shown) in section 16 immediately adjacent a selected peg 17. The bolt 25 is provided with a knurled head 27 and a small diameter passage is drilled, or otherwise formed, to extend throughout the length of the bolt. An elongated rod 28 is received within the passage with the distal end protruding beyond the bolt and supporting a string guide 29 which engages a string 30 attached to the selected peg. As shown in FIG. 5, the string guide is a cylindrical member having a circumferential groove to receive the string and a laterally-extending opening in which the rod 28 is clamped by means of a set screw 20. The opposite end 31 of the rod 28 protrudes beyond the knurled head 27 into the interior of the housing and is connected to an actuator cable 32. The cable is received within a tubular casing 33 which is provided with an attachment fixture 34, 35 at each end. The attachment fixtures include a wing nut 36, 37 which is crimped onto the casing 33 and an externally-threaded tube secured to the wingnut and protruding therefrom. Attachment fixture 34 is secured to end member 38 of housing 22 with the externally-threaded tube extended through an opening in the end member and then clamped in place by a nut threaded onto the tube. Attachment fixture 35 is similarly clamped to a pressure-responsive actuator 40 which is illustrated in FIGS. 3 and 4. The actuator 40 includes a flat, rectangular plate 41 which is provided with an end wall 39 and a pair of spaced projections 42, 43 located-at approximately mid-length along the opposite edges. A lever 44 is pivotally mounted between projections 42 and 43 for movement toward and away from the plate 41. Attachment fixture 35 is clamped to end wall 39 and the cable 32 is secured to the lever 44.

After the apparatus of the present invention is installed on the musical instrument, the extent of variation of the pitch of the string with which it is associated can be selected. The bolt 25 is threaded into the end member 23 so that, by rotation of the knurled head 27, the bolt can be moved axially within the opening in section 16. The free end of bolt 25, which serves as a stop for string guide 29, can thus be positioned relative to the designated string to control or limit the deflection or "bending" of the string. Since the tension on the string increases as it is deflected, the frequency of vibration and the pitch of the tone produced is similarly increased. Thus, by positioning the free end of bolt 25 the throw of the rod 28 and string guide 29 is controlled to provide the amount of deflection of the designated string necessary to produce the tone desired, whether a whole note or some portion thereof.

As illustrated in FIG. 3, the actuator 40 is typically suspended from the shoulder of the musician by a sling or strap 46 such that lever 44 is aligned with the musicians' elbow. In this position, the lever can be depressed by the musician moving his arm, thus exerting tension on the cable 32 and rod 28 to "bend" string 30. For studio use, or for use with an electric guitar, the actuator 40 can be positioned on the floor and pressure applied to lever 44 by the musicians' foot. With either method of actuation, the degree of variation in pitch is determined by the throw of the rod 28 and string guide 29. However, by varying the rate at which pressure is applied to lever 44, the variations in tone can be achieved slowly or suddenly, as desired.

While the invention has been described with reference to specifically illustrated preferred embodiments, it should be realized that various changes may be made without departing from the disclosed inventive subject matter particularly pointed out and claimed herebelow. For instance, in situations where electrical power is available on the instrument, an electrical actuation system may be desireable. In such case, the actuator cable assembly and the housing could be replaced with an electrical solenoid which is activated by a switch on the instrument.

I claim:

1. For use with a musical instrument which includes a body and a peghead with a plurality of strings mounted under tension between the body and a series of manually adjustable pegs in the peghead, a device for periodically varying the pitch of at least one of said strings without adjusting said pegs, said device including:

reciprocating means adapted to be mounted on the peghead in proximity to said pegs, said means including a rod adapted to extend through a hole in the peghead, a string guide secured to the distal end of the rod and adapted to overlie and bear against one of said strings, and a housing adapted to be secured to the peghead surrounding the proximal end of the rod, said housing including an end member having an internally threaded opening, an externally threaded elongated element which is provided with a longitudinal passage in which the rod is received, said elongated element being threadedly received in said opening and adapted to extend through the hole in the peghead into proximity with the string guide, and means on said elongated element for rotating it to adjust the position of the distal end thereof relative to said string guide, and manually operable means to retract the reciprocating means and increase the tension on the associated string in response to movement by a musician playing the instrument, said manually operable means including a pressure responsive actuator having a base plate with a laterally extending wall and at least one projection, a lever pivotally mounted on the projection for access by the musician, an elongated cylindrical casing with an actuator cable telescoped therein, said casing having one end secured to the housing and the opposite end secured to the wall, said cable having one end connected to the proximal end of the rod and the opposite end connected to the lever, and a supporting strap attached to said base plate and adapted to fit over a shoulder of a musician and support the lever in alignment with the musician's elbow.

* * * * *